United States Patent [19]

de Winter

[11] 4,316,550

[45] Feb. 23, 1982

[54] CANISTER CLOSURE

[75] Inventor: Koen M. M. de Winter, Lochem, Netherlands

[73] Assignee: Mepalservice B.V., Lochem, Netherlands

[21] Appl. No.: 54,893

[22] Filed: Jul. 5, 1979

[51] Int. Cl.[3] ..... B65D 39/12; B65D 39/16

[52] U.S. Cl. ..... 215/360; 215/331; 220/235

[58] Field of Search ..... 215/364, 270, 358, 361, 215/, 360, 330, 331, 260; 220/235, 236, 237, 233, 234

[56] References Cited

U.S. PATENT DOCUMENTS

| | | | |
|---|---|---|---|
| 986,297 | 3/1911 | Kinkade | 220/236 |
| 2,116,170 | 5/1938 | Hall | 220/236 |
| 2,199,749 | 5/1940 | Mazarie | 220/235 X |
| 2,258,135 | 10/1941 | Curtis | 220/235 X |
| 2,822,104 | 2/1958 | Busch | 215/330 X |
| 2,913,140 | 11/1959 | Vuillemenot | 220/306 |
| 2,966,276 | 12/1960 | Hins | 215/270 |
| 3,244,308 | 4/1966 | Esposito, Jr. | 215/270 |
| 3,721,361 | 3/1973 | Barry et al. | 215/330 |
| 3,809,276 | 5/1974 | Landen | 215/330 X |
| 4,083,468 | 4/1978 | Batchelor | 220/234 |

FOREIGN PATENT DOCUMENTS

| | | | |
|---|---|---|---|
| 2425985 | 12/1975 | Fed. Rep. of Germany | 215/360 |
| 1569000 | 5/1967 | France | 215/360 |
| 2048094 | 3/1971 | France | 220/235 |
| 307680 | 5/1933 | Italy | 220/233 |

*Primary Examiner*—Allan N. Shoap
*Attorney, Agent, or Firm*—Brumbaugh, Graves, Donohue & Raymond

[57] ABSTRACT

A closure is provided for canisters, in particular canisters having a relatively large mouth or opening, and designed for keeping foodstuffs in the kitchen. The canister opening is defined by a sidewall, and the closure comprises a skirt that is radially expandable in a controlled manner for clamping inside of the sidewall, or releasing the sidewall, to seal or open the canister opening. For the controlled expansion or contraction of the skirt of the closure, the skirt is flexibly connected to a convex bottom. The bottom includes a conical, relatively rigid intermediate ring panel sloping downwardly toward the interior of the canister from the skirt, and a rigid central panel circumferentially hinged to the intermediate panel and axially movable in a controlled manner for varying the slope of the annular intermediate panel, thus varying the effective diameter of the skirt. A major advantage of the invention is that the closure is clamped in the canister opening by the closure bottom being clamped from more convex to less convex, whereby a subatmospheric pressure is generated in the interior of the canister, which is conducive to retaining the closure in the canister opening. The bottom is not permitted to become completely flat or become concave.

3 Claims, 6 Drawing Figures

I
II
III
IV
1
2
3
4
5
6
7
8
9
10
11
12
13
14
15
16
17
18
19
20
21
22
23
24
25
26
28
29
30
31
α

CANISTER CLOSURE

BACKGROUND OF THE INVENTION

This invention relates to a closure for round-mouthed canisters, in particular a closure having portions which are inserted into the mount of the canister and clamped therein through radial expansion of an annular wall portion or skirt of the closure.

A closure of the above kind, designed for a bottle or a like container, and comprising a skirt flexibly connected with a bottom composed of an intermediate ring panel and a central panel, is disclosed in U.S. Pat. No. 3,244,308 to Vincent J. Esposito. At the upper end of the skirt there is provided a peripheral flange which through abutment against the rim of a container sidewall defining a container opening limits the depth to which the closure is lowered into the opening. In the starting position, the bottom of the closure has a concave shape, that is to say, the bottom faces the container space to be sealed with a hollow side. For clamping the closure in the container opening, the central panel of the closure bottom is depressed through its dead center.

A disadvantage of the Esposito closure is that, in the closed position, the bottom has been pressed beyond its dead center, which means that the annular wall of the closure does not have the maximum outward diameter. The diameter of the skirt of the closure is increased because of a decrease in the absolute value of the slope of the intermediate portion. The largest diameter corresponds to no slope at all. As a consequence, the sealing effect depends to a great extent of the elasticity of the material of the closure, particularly the material of the skirt portion. In addition, a rather accurate fit in the container opening is required.

Another drawback of the Esposito closure is that movement of the closure bottom from concave to convex during closing causes a superatmospheric pressure to be generated within the container closing. Such a superatmospheric pressure, even if not arising from movement of the closure bottom but, for example, from an increase in temperature, will tend to flex the bottom back through its dead center to its concave position and thus automatically release the cover.

A further drawback of the Esposito closure is that, because of the single-wall construction, its transverse structural strength is limited. In particular, the clamping force is limited for closure of wider openings, unless thick materials are used.

U.S. Pat. No. 2,966,276 to Hing, relates to a double-walled stopper with a bottom member which is moved from a convex starting position, as viewed from the interior of the container, to a concave sealing position. As with the Esposito disclosure, the closure bottom wall is pulled through the flat configuration. There are no gradual transitions between the release position and the clamping position, and a relatively complicated central knob serves for fixing at least the concave sealing position.

German Offenlegungsschrift No. 2,425,985 to Zimmerman relates to a double-walled closure, which includes a top portion and a bottom portion in which the bottom portion includes a skirt designed for clamping against the wall of a container opening, and in which the center of the bottom portion is connected through threaded elements with the top cover. Rotation of the top portion deforms the bottom portion from a flat starting position to a concave position, viewed from the interior of the container, to thereby laterally spread the skirt of the bottom portion, which becomes wedged in the container opening. This closure of Zimmerman can only function if the bottom portion and the skirt of the bottom portion are made of elastic material, and hence the closure is only suitable for container openings having a small diameter, such as vacuum flasks.

It is an object of the invention to provide a canister closure suitable for canisters with a wide opening, in the order of 110 mm diameter, which canisters are suitable for storing foods in kitchens, such as macaroni, beans, peas, coffee, tea and the like, and which overcomes the drawbacks of the prior art to the extent that the closure is structurally strong, so that a large clamping force can be exercised even with large diameters, and the sealing range is accurately controllable within a range in which, starting from a convex position of the closure bottom portion, as viewed from the interior of the canister, the bottom curvature is varied to less convex, but the bottom never become flat or concave.

Another object of the invention is to provide such a large diameter closure which enables the user to apply the desired amount of clamping force even with dimensional variations usually experienced in canister openings.

SUMMARY OF THE INVENTION

In accordance with the present invention there is provided an improved closure for a canister having a cylindrical sidewall, a closed bottom, and an open top. The improved closure includes a bottom portion comprising a substantially flat central panel flexibly connected at its outer radial edge to a relatively rigid conically-shaped intermediate ring panel. The intermediate panel has a radial cross section which is inclined upwardly and outwardly from the central panel. The intermediate panel is circumferentially attached to a radially expandable skirt. The improved closure also includes a top portion marginally bearing on the bottom portion and provided with means for axially displacing the central panel of the bottom portion with respect to the top portion thereby to reduce the angle of the upwardly inclined intermediate panel, expand the outer diameter of the skirt and cause the skirt to clamp against the inner surface of the side wall.

According to the preferred embodiments of the invention, the means for axially displacing the central panel includes threaded elements on the bottom and top portions of the closure which engage each other. The bottom portion may also include means for engaging the side wall to prevent rotation of the bottom portion with respect to the sidewall. There may also be provided stops for preventing excess rotation of the two portions with respect to each other.

For a better understanding of the present invention, together with other and further objects, reference is made to the following description, taken in conjunction with the accompanying drawings, and its scope will be pointed out in the appended claims.

DESCRIPTION OF THE PREFERRED EMBODIMENT

Figures 5, 6:
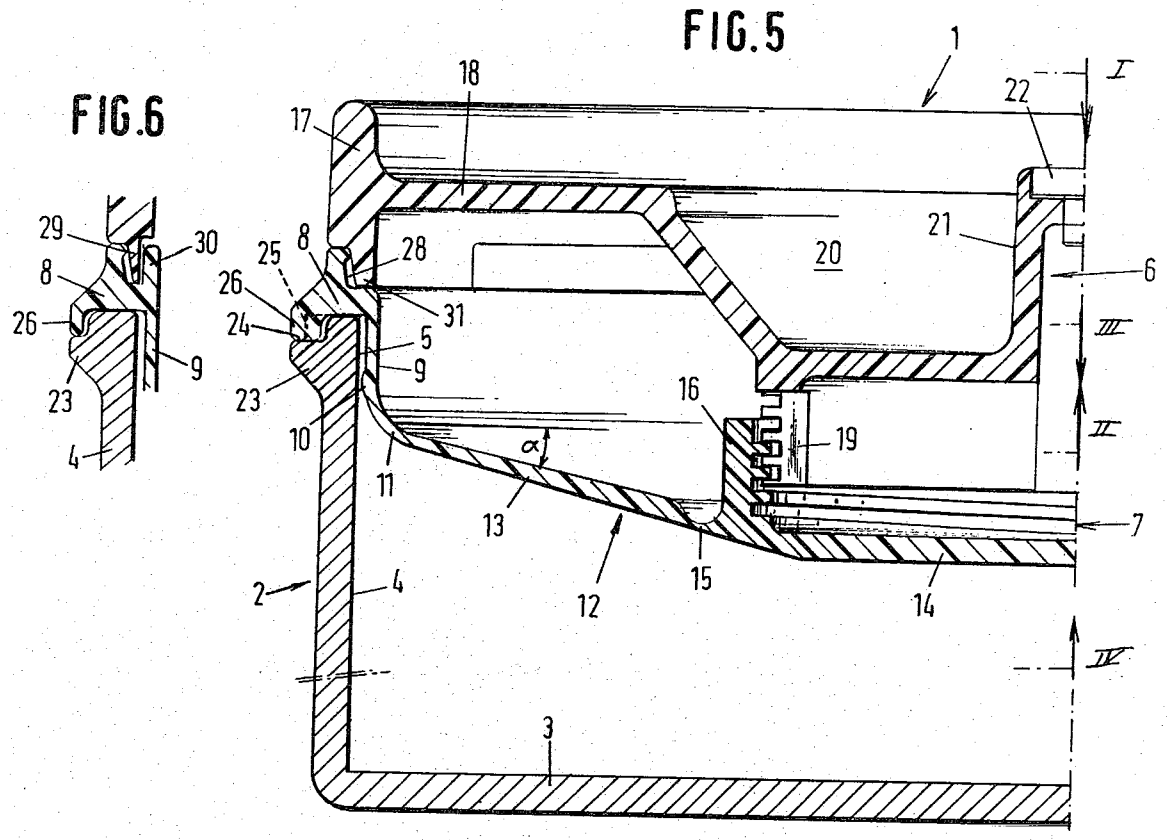
FIG. 5 is an axial cross-sectional view of a canister closure in accordance with the present invention shown mounted to a canister.
FIG. 6 is a partial cross-sectional view of the closure edge of the canister cover in accordance with the present invention taken along lines VI—VI shown in FIG. 3.

The accompanying drawings, especially the cross-sectional view of FIG. 5, illustrate a closure 1 in accordance with the present invention fitted onto a canister 2 having a closed bottom 3, a cylindrical sidewall 4 and an opening 5. The closure 1 comprises a top portion 6 and a bottom portion 7. Bottom portion 7 includes a radially outwardly extending peripheral flange 8, a radially and resiliently expandable cylindrical skirt 9 depending from flange 8. Skirt 9 has a bead 10 on its periphery. Skirt 9 merges via a flexible bend 11 into a bottom 12 comprising a relatively rigid, conical intermediate ring panel 13 sloping inwardly at an angle $\alpha$, and a flat central panel 14 connected to panel 13 through a circumferential hinge 15 formed by thinning out the bottom portion material. Extending at the top of central panel 14 is an internally threaded tubular stub 16.

Top portion 6 comprises a peripheral rim 17 and a cover wall 18 centrally carrying a tubular stub 19 with external threading, fitting in the threading of stub 16. Cover wall 18 of top portion 6 is provided with two depressions 20 which between them enclose a flat central portion 21 which can serve as a hand grip for rotating top portion 6. The top surface of hand grip 21 is recessed at 22 for the application of markings and the like.

Figure 4:
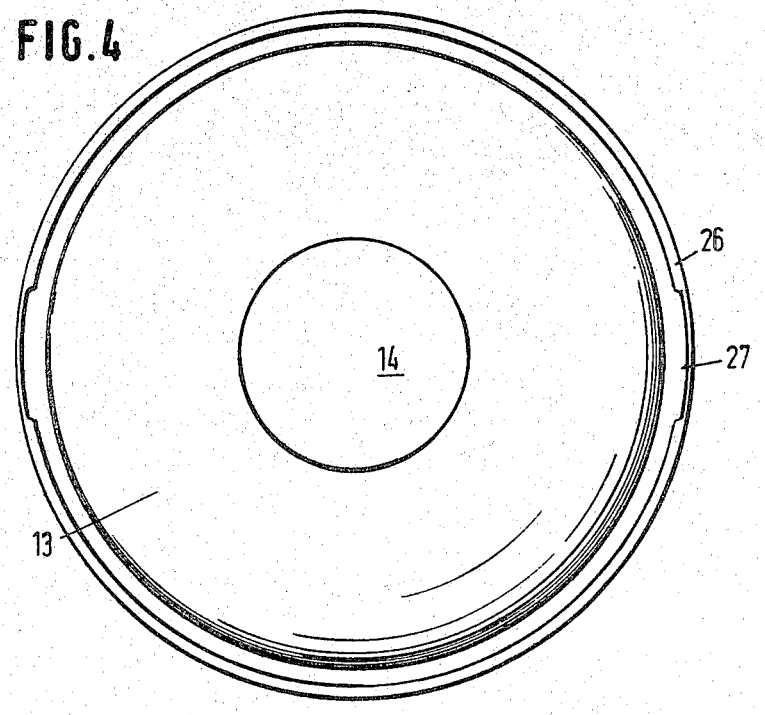
FIG. 4 is a bottom view of a canister closure in accordance with the present invention.

Canister 2 is provided at the upper rim of sidewall 4 with a radially outwardly extending flange 23, above which is a recess 24 extending peripherally of the canister and interrupted at at least one position by a dog 25. Flange 8 of bottom portion 7 is formed at the radially outer end with a depending skirt 26 which fits recess 24 and has recesses 27 (see FIG. 4) for receiving dogs 25.

Figure 1:
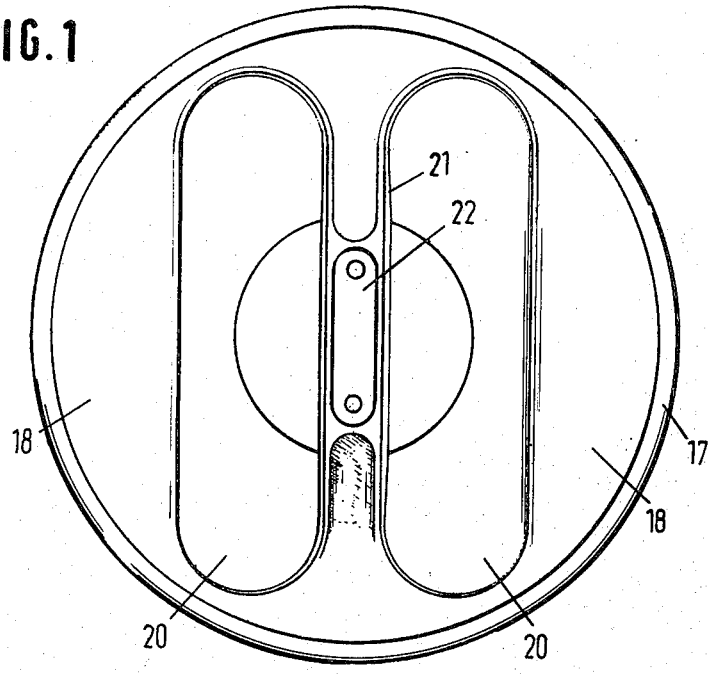
FIG. 1 is a top view of a canister closure in accordance with the present invention.
Figure 2:
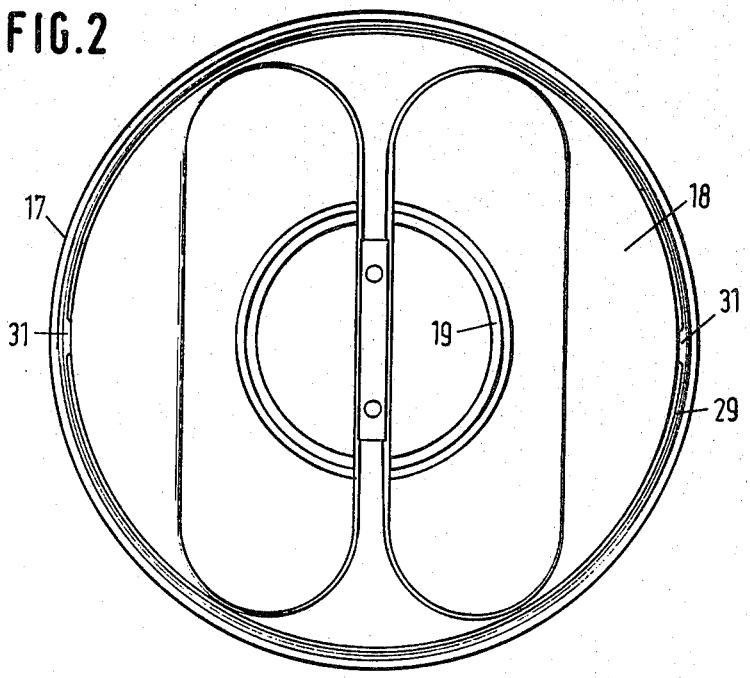
FIG. 2 is a bottom view of the top portion of a canister closure in accordance with the present invention.
Figure 3:
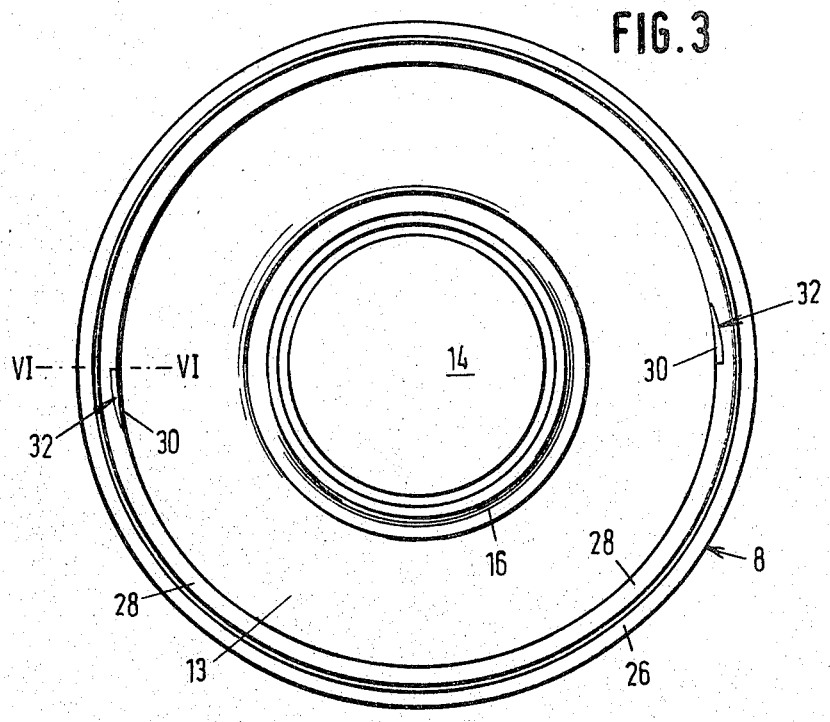
FIG. 3 is a top view of the bottom portion of a canister closure in accordance with the present invention.

Flange 8 of bottom portion 7 is provided at the top with a recess 28 (see FIGS. 3 and 5) located at the radially inner side, and which fits a ridge 29 depending from the rim 17 of top portion 6. As shown in FIG. 3 (see also FIG. 6) stops 30 are arranged diametrically opposite to each other in recess 28. As shown in FIG. 2, ridge 29 of top portion 6 has local bosses 31. During rotation of top portion 6 relative to bottom portion 7 stops 30 are located in the path of bosses 31.

Stops 30 have a bevel 32 formed on their radially outward side, in the manner shown in FIG. 3.

Canister 2, top portion 6 and bottom portion 7 are each separately made. Canister 2 can be made, for example, by injection molding from, e.g., transparent styrene acrylonitrile (SAN), while the closure portions 6 and 7 can be made from polypropylene (PP). An esthetically pleasing appearance is obtained with a top portion 6 in a bright color with the bottom portion 7 for example being white.

OPERATION OF THE CANISTER CLOSURE

The separately made bottom and top portions of the closure must first be coupled together. This is done by screwing the threaded stubs 16 and 19 one into the other. After some turns ridge 29 of top portion 6 will be received in peripheral recess 28 of the bottom portion. As soon as bosses 31 of ridge 29 of top portion 6 come into contact with stops 30 in recess 28 of bottom portion 7, rotation in one direction is possible only, i.e., clockwise in FIG. 3. For only then will bosses 31 be able to slide over bevels 32 of stops 30. Rotation in the opposite direction is prevented through abutment of bosses 31 and stops 30.

When the closure has thus been assembled it can be placed in the mouth 5 of a canister 2 with skirt 9 extending into mouth 5. The depth to which skirt 9 can be inserted is limited by abutment of flange 8 with the rim of the cylindrical canister sidewall 4. Rotation of bottom portion 7 relative to canister 2 is prevented through dogs 25 being received in recesses 27 in skirt 26 of bottom portion 7.

In FIG. 5 this starting position is shown, with peripheral bead 10 of skirt 9 being still slightly spaced from wall 4. When hand grip 21 of top portion 7 is gripped and the latter is rotated clockwise the central panel 14 of the bottom portion is pulled upwards, whereby the angle $\alpha$ of conical intermediate ring panel 13 is decreased and the diameter of skirt 9 is increased. This increase in diameter results in the closure being clamped within canister mouth 5. Stubs 16 and 19 are dimensioned to prevent angle $\alpha$ from being reduced to zero or becoming negative, that is, prevent the panel from being pulled beyond its horizontal position. Flexing beyond the horizontal position would cause a reduction of the diameter of skirt 9 from its maximum diameter which is achieved in the horizontal condition.

The "sealing range" of the closure, i.e., the maximum diameter variation of bead 10 is accordingly determined by the length of stubs 16 and 19.

As the diameter variation of bead 10, or of skirt 9, is controlled by a change in slope of intermediate panel 13, with care being taken that from the convex position as shown, as viewed from the interior of the canister, panel 13 can only vary to a different convex position with a smaller angle $\alpha$, it is ensured that the fixing of closure 1 in canister 2 is always concomitant with an increase in volume of the interior of canister 2, i.e., with the generation of a subatmospheric pressure, which is conducive to the canister being kept closed. The clamping force is determined by the user himself. The system of stops 30 and bosses 31 of the bottom and top closure portion, respectively, prevents the top portion, once mounted, from being released from the bottom portion. Naturally care must be taken that the contemplated maximum axial displacement of central panel 14 is possible within the rotatability of the top portion relative to the bottom portion as defined by stops 30 and bosses 31, which in the embodiment shown is less than 180°. To remove the cover, a rotation of the cover in the opposite direction to substantially 180° will displace the central panel toward the canister interior, thereby retracting the skirt and releasing the cover from the canister.

The canister closure according to the invention is structurally strong owing to the double-walled construction (wall 12 of the bottom portion and wall 18 of the top portion), and the range of diametrical expansion is sufficiently large to compensate for dimensional tolerances. Such dimensional tolerances, which occur with both the closure and the canister, are the result of the use of dissimilar starting materials, which may for example originate from different suppliers. In addition, even materials supplied by one and the same supplier have a large specified range of shrinkage. Thus, for example, with a canister of SAN having a mouth 5 of 110 mm and a shrinkage of 0.2–0.6% and a closure of PP having a shrinkage of 1–2%, there may theoretically be a dimensional difference in the order of 2 mm.

In the closure according to the present invention with an angle varying between 15° and a "safe" angle of 5° (i.e., an angle $\alpha$ at which spontaneous passage through the dead center is virtually excluded) the range of expansion is 2 mm, the first 3° of change in slope (angle $\alpha$ from 15° to 12°) of the intermediate panel 13 producing an increase in diameter at bead 10 of approximately 1 mm.

In practice the tolerances referred to can thus easily be compensated for without full use of the maximum diameter variation of skirt 9.

Canisters 2 for the storage of foodstuffs can of course have any desired dimensions. In practice the closures according to the present invention have been found to ensure proper sealing even with relatively large canister mouth diameters of, for example, 110 mm. Such canisters may vary in height and in practice are being made by the present Assignees in heights varying between 50 and 300 mm. By virtue of peripheral flange 23, the canisters may be kept in a kitchen, hanging from a so-called canister shelf.

While there has been described what is believed to be the preferred embodiment of the invention, those skilled in the art will recognize that various changes and modifications may be made thereto without departing from the spirit of the invention, and it is intended to claim all such embodiments as fall within the true scope of the invention.

I claim:

1. In combination, a canister and an appurtenant closure, said canister having a closed bottom, a cylindrical sidewall and a canister opening or mouth at the upper end thereof having a rim, the canister sidewall being provided adjacent to its upper end with a radially outwardly extending flange, and said canister closure being of two-piece construction comprising a bottom portion and top portion, said bottom portion having a radially outwardly extending peripheral flange provided on its radially outer side with a depending portion having at least one recess, and said rim of said canister having a complementary marginal recess for receiving said depending portion, said marginal recess having a fitting dog for engaging said recess on said depending portion, a radially expandable peripheral skirt depending from said radially outwardly extending peripheral flange, and a transverse wall flexibly connected to said radially expandable peripheral skirt, said transverse wall comprising a substantially rigid, conically-shaped intermediate ring panel extending inwardly and downwardly inclined from said skirt, and a rigid, substantially flat, central panel hinged to said intermediate ring panel through local material reduction, an internally threaded tubular stub arranged on the upper side of said central panel, the top portion having a peripheral rim and a cover wall provided centrally on its bottom surface with an externally threaded tubular stub, the portions being arranged to allow the stub carried by the top portion to be screwed into the stub on the bottom portion with the peripheral rim of the top portion resting on the peripheral flange of the bottom portion, thereby to cause the central panel of the bottom portion to be pulled towards the top portion, thereby to decrease the slope of the intermediate panel from its initial angle to a smaller angle measured from the central panel and thereby to increase the outer diameter of the skirt of the bottom portion and, when placed in the canister opening or mouth, the closure is thereby clamped against the canister sidewall.

2. The combination of claim 1, wherein the outwardly extending peripheral flange of the bottom portion of the closure is provided with an annular upstanding portion having on the radially inner side thereof a peripheral recess, and the peripheral rim of the top portion is provided with a downwardly depending skirt that can be received in said peripheral recess, said skirt having two diametrically opposite bosses, and wherein said peripheral recess is provided with stops diametrically opposed to each other and provided with a bevel, the arrangement being such that the bosses of the top portion can only pass the stops of the bottom portion in the screwing-in direction of said screwthreaded stubs, so that, in the assembled closure unit, the operative stroke of the top portion may be limited to 180° relative to the bottom portion, whereby the top and bottom portions are prevented from being released from each other.

3. The combination of claim 1, wherein the portion includes depressions separated by a flat portion to provide a handgrip for rotating the top portion relatively to the bottom portion.

* * * * *

UNITED STATES PATENT AND TRADEMARK OFFICE

CERTIFICATE OF CORRECTION

PATENT NO. : 4,316,550

DATED : February 23, 1982

INVENTOR(S) : Koen Modest Maria DeWinter

It is certified that error appears in the above—identified patent and that said Letters Patent is hereby corrected as shown below:

First page, first col., penultimate line, "5/1967" should read --5/1969--;

Col. 1, line 7, "mount" should read --mouth--;

Col. 2, line 20-1/2, "become" should read --becomes--;

Col. 5, line 6, after "invention" insert a comma;

Col. 6, line 44, before "portion" insert --top--.

Signed and Sealed this

*First* Day of *June 1982*

[SEAL]

*Attest:*

GERALD J. MOSSINGHOFF

*Attesting Officer*

*Commissioner of Patents and Trademarks*